US005597257A

United States Patent [19]

Habing

[11] Patent Number: 5,597,257

[45] Date of Patent: Jan. 28, 1997

[54] ADJUSTABLE PRESS ARM

[76] Inventor: Theodore G. Habing, Pacific Fitness Corporation, 6600 W. Katella Ave., Cypress, Calif. 90630

[21] Appl. No.: 217,199

[22] Filed: Mar. 23, 1994

[51] Int. Cl.[6] ..... A63B 21/00

[52] U.S. Cl. ..... 482/100; 182/137; 182/908

[58] Field of Search ..... 482/97, 99–103, 482/135–139, 908

[56] References Cited

U.S. PATENT DOCUMENTS

| | | | |
|---|---|---|---|
| 4,549,733 | 10/1985 | Salyer | 482/103 |
| 4,898,381 | 2/1990 | Gordon | 482/103 |
| 5,067,708 | 11/1991 | Olschansky et al. | 482/100 |
| 5,120,289 | 6/1992 | Yu | 482/137 |
| 5,236,406 | 8/1993 | Webber | 482/100 |
| 5,263,915 | 11/1993 | Habing | 482/99 |

OTHER PUBLICATIONS

Paramount CTx brochure, Paramount Fitness Equipment Corp. 1990, 2 pages.

*Primary Examiner*—Richard J. Apley
*Assistant Examiner*—John Mulcahy
*Attorney, Agent, or Firm*—Blakely, Sokoloff, Taylor & Zafman

[57] ABSTRACT

A press exercise machine allows the press arm of the machine to be adjusted to various rest positions without creating slack in the system. The machine has a frame that supports a seat and a weight stack that is mechanically coupled to a press arm by a cable. The press arm is adapted to be rotated on the frame, wherein the cable is pulled and the weight stack is lifted from a rest position. In the rest position, the press arm abuts against a sleeve which can slide along an adjustment arm that extends from the frame. The user can move the sleeve to a number of locations on the adjustment arm to vary the rest position of the press arm. The cable is coupled to a first pulley that is attached to the sleeve and a second pulley that is attached to the arm. The cable is also guided by a third pulley that is attached to the frame. The spatial relationship of the pulleys is such that the cable remains slack free for all rest positions of the press arm.

11 Claims, 4 Drawing Sheets

FIG. 3
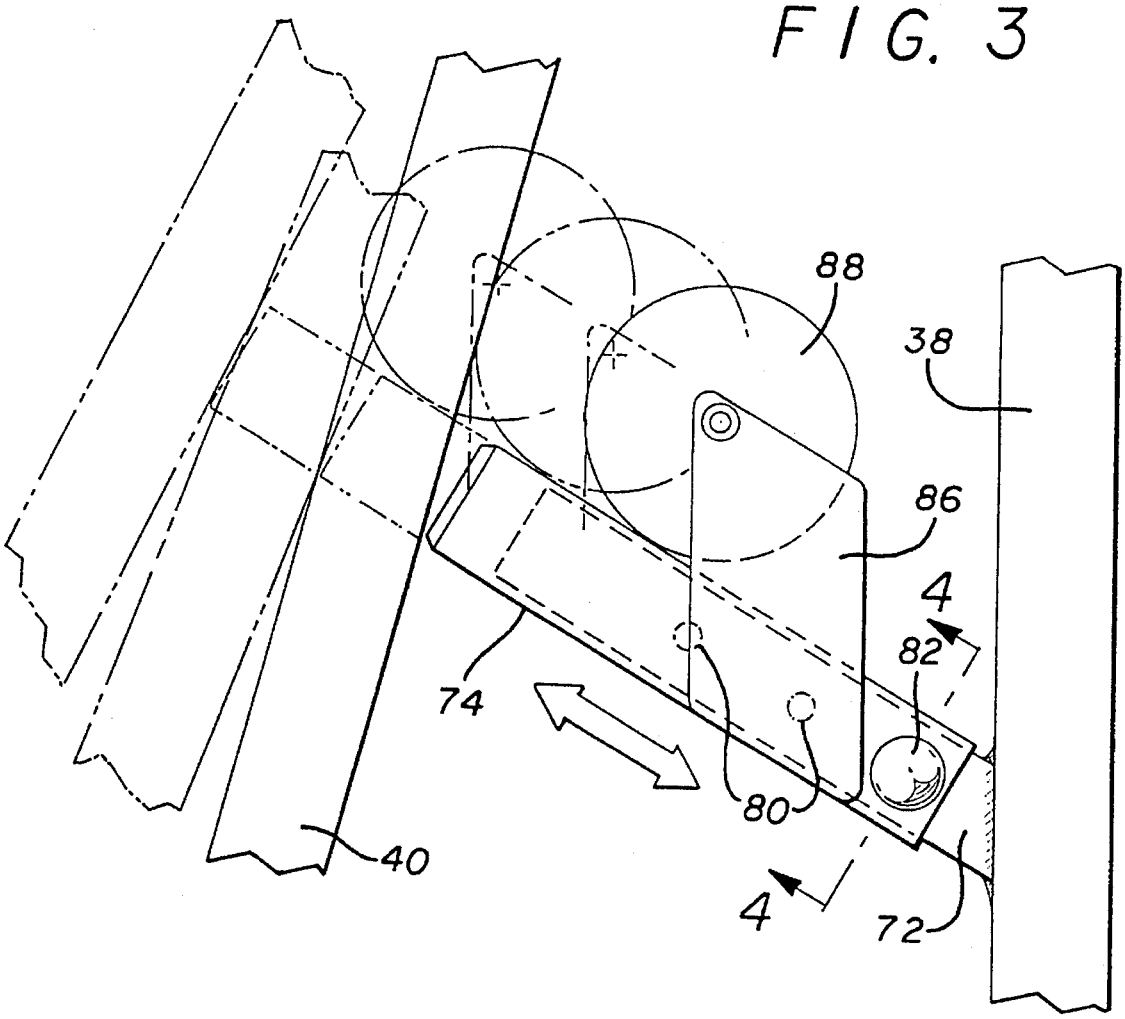
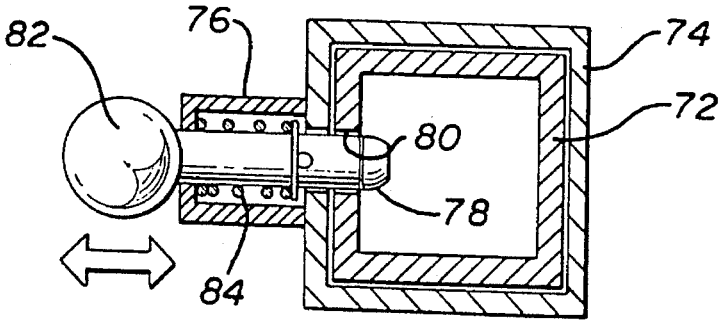
FIG. 4

ADJUSTABLE PRESS ARM

BACKGROUND OF THE INVENTION

1. Field of the Invention

The present invention relates to exercise equipment, in particular a weight machine that is typically used to perform chest press, incline press, shoulder press and rowing exercise routines.

2. Description of Related Art

Exercise machines typically have a series of cables and pulleys that mechanically couple a moveable exercise member to a weight stack. The weight stack is lifted by pushing or pulling the exercise member from a rest position. One such type of exercise machine employs a press arm as the exercise member, which is coupled to a weight stack by a cable/pulley assembly. The press arm and cable/pulley assembly are supported by a frame that allows the user to exercise while in a seated position. The weight stack is lifted by moving the press arm away from the user, thus providing the same exercising motion as performed with a conventional "free weight" bench press.

The distance between the back pad of the seat and the press arm is typically fixed. Therefore, users of different physical size will have different starting positions. The different starting positions will vary the range of lifting motion for each user, thereby affecting the impact of the exercise routine.

It is preferable to provide a press arm machine with an adjustable back pad that allows the user to perform variable pressing exercises from different starting positions. For some exercise routines, it is more desirable for the user to be in an inclined position, for other routines the user may want to be in a more upright position. Compensating for various users, or different starting positions, typically requires moving the press arm to a new resting position. Various mechanisms have been developed for providing a starting position adjustment for press arm exercises. Many of these prior art "pre-stretch" adjustment mechanisms provide an adjustment for the cable system, but do not provide an adjustable stop for the press arm. A mechanism of this type is shown in this inventor's U.S. Pat. No. 5,263,915.

Another mechanism for adjusting a rest position of a press arm is shown in U.S. Pat. No. 5,236,406. In this mechanism, the press arm is selectively positioned with respect to a pivoting block assembly. All cable paths are unaffected by a change in the rest position of the press arm. This particular mechanism, however, is relatively complex and therefore expensive to manufacture. The adjustment pin is necessarily placed at a relatively high position above the operator's head and is therefore somewhat difficult to adjust from a sitting position. Placement of the adjustment pin near the pivot point of the press arm also places a high shear load on the adjustment pin during the performance of press exercises.

It is desirable to provide a press arm exercise machine in which the press arm may be simply and conveniently adjusted to a new starting position with a positive stop while maintaining the cable system in a slack free condition.

SUMMARY OF THE INVENTION

The present invention is a press exercise machine that allows the press arm of the machine to be adjusted to various positions without creating slack in the cable system of the machine. The machine has a frame that supports a seat and a weight stack that is mechanically coupled to a pair of press arms by a cable. The press arm is pivotally coupled to the frame and also coupled to the cable so that the cable is pulled and the weight stack is lifted from a rest position as the press arm is pushed forwardly. In the rest position, the press arm abuts against a sleeve which can slide along an adjustment arm that extends from the frame. The user can move the sleeve to a number of locations on the adjustment arm to vary the rest position of the press arm.

The cable is guided by a first pulley that is attached to the sleeve and a second pulley that is attached to the press arm, or may extend around a pulley on the arm and continue up to a high pulley for additional pull-down exercises. The cable is also guided by a third pulley that is attached to the frame. The angular relationship of the pulleys is such that the cable remains slack free for all sleeve and press arm locations. The back pad is also adjustable, wherein the user may move the back pad and press arm to a variety of operating positions, without affecting the resistance curve of the machine.

Therefore it is an object of the present invention to provide a press exercise machine that allows the press arm of the machine to be moved into a variety of rest positions without creating slack in the cable system.

BRIEF DESCRIPTION OF THE DRAWINGS

The objects and advantages of the present invention will become more readily apparent to those ordinarily skilled in the art after reviewing the following detailed description and accompanying drawings, wherein:

FIG. 3 is an enlarged side view of the exercise machine of FIG. 1 showing a sleeve adjustment member;

FIG. 4 is a cross-sectional view taken at line 4—4 of FIG. 3, showing a spring loaded pin extending into a hole of an adjustment arm;

DETAILED DESCRIPTION OF THE INVENTION

Figure 1:
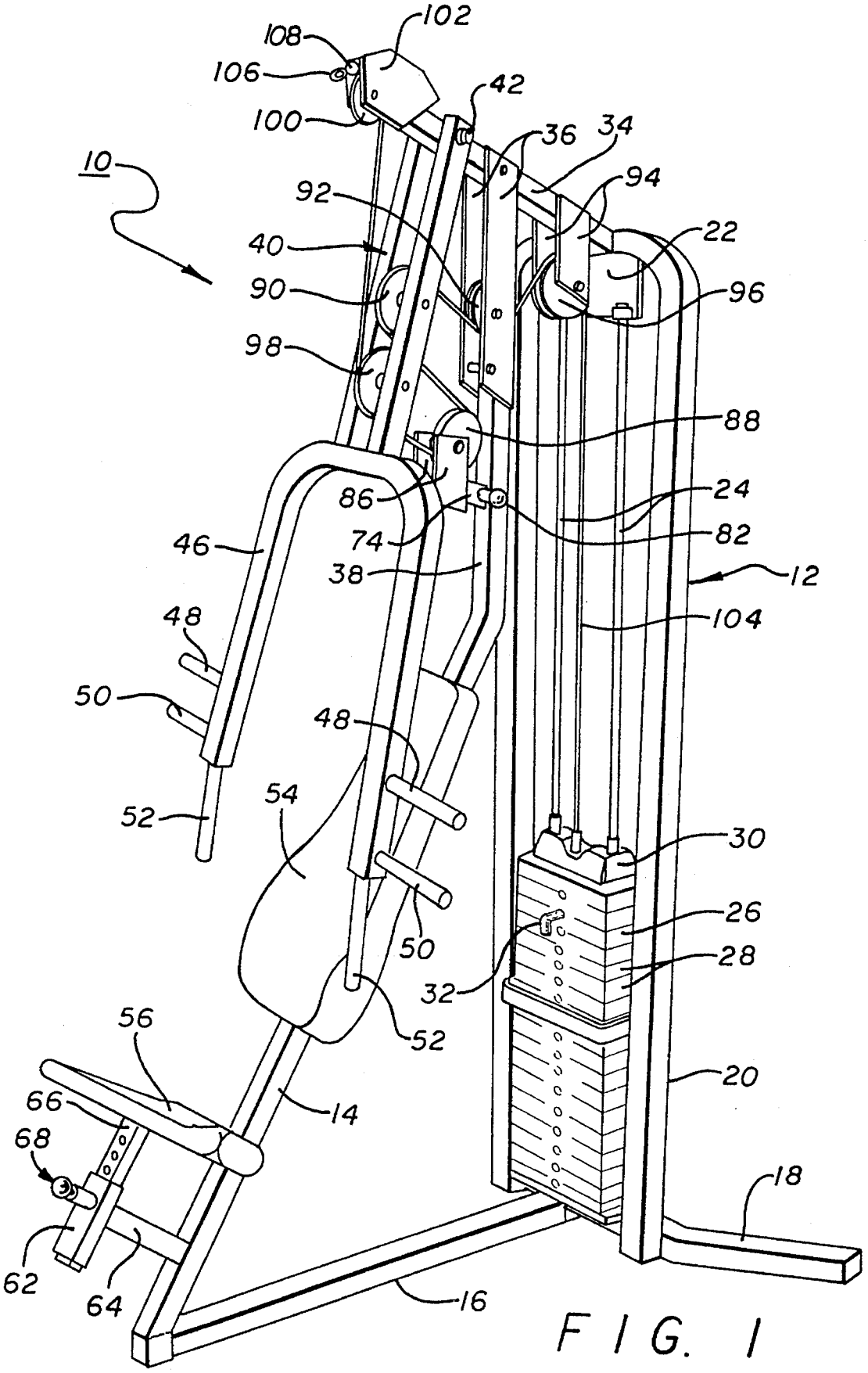
FIG. 1 is a perspective view of an exercise machine of the present invention.

Referring to the drawings more particularly by reference numbers, FIG. 1 shows an exercise machine 10 of the present invention. The machine has a frame 12 that is typically constructed from tubular steel that is both light and strong. The frame 12 has a fixed frame subassembly 14 that includes a base member 16 which has a pair of feet 18 that support and balance the frame 12. Rigidly attached to the base member 16 is a weight frame 20 that extends essentially perpendicular from the feet 18. The frame 20 is preferably bent into a C shape to improve the strength and appearance of the member 20.

Attached to the weight frame 20 is a guide bracket 22 that supports a pair of weight guides 24. The weight guides 24 are preferably a pair of rods that extend essentially parallel with the weight frame 20. Between the uprights of weight frame 20 is a weight stack 26 that includes a plurality of individual weights 28. Attached to the top of the weight stack 26 is a lift plate 30. The lift plate 30 has a selector rod (not shown) that extends through the weights 28. A selector pin 32 can be inserted beneath each individual weight and into the selector rod, to couple any desired number of weights to the lift plate 30. The selector pin 32 and lift plate 30 arrangement can be used to vary the amount of exercise resistance as is well understood by those skilled in the art.

The frame 12 has a top member 34 attached to the weight frame 20. Attached to member 34 are a pair of seat frame support brackets 36. The brackets 36 support a seat frame member 38 that is connected to the base member 16. A press arm 40 is pivotally connected to the support member 34 by a pivot pin 42. The pivot pin 42 is attached to the press arm 40 and extends through the support member 34, so that the arm 40 can pivot relative to the fixed frame subassembly 14.

The press arm 40 includes a pair of spaced apart bars 44 extending from the support member 34. Rigidly attached to the support bars 44 is a handle frame member 46. Connected to the handle frame 46 are a pair of upper handles 48 and a pair of lower handles 50. The frame member 46 may also have a pair of vertical handles 52. The variety of handles provides the user with a number of different operating positions. The multiple handle arrangement also allows different exercise routines to be employed by various users. The handles are preferably spaced apart a predetermined transverse distance approximating the locations of the user's arms. The handles may be textured or provided with grips to improve the grasping of the same.

Figure 2:
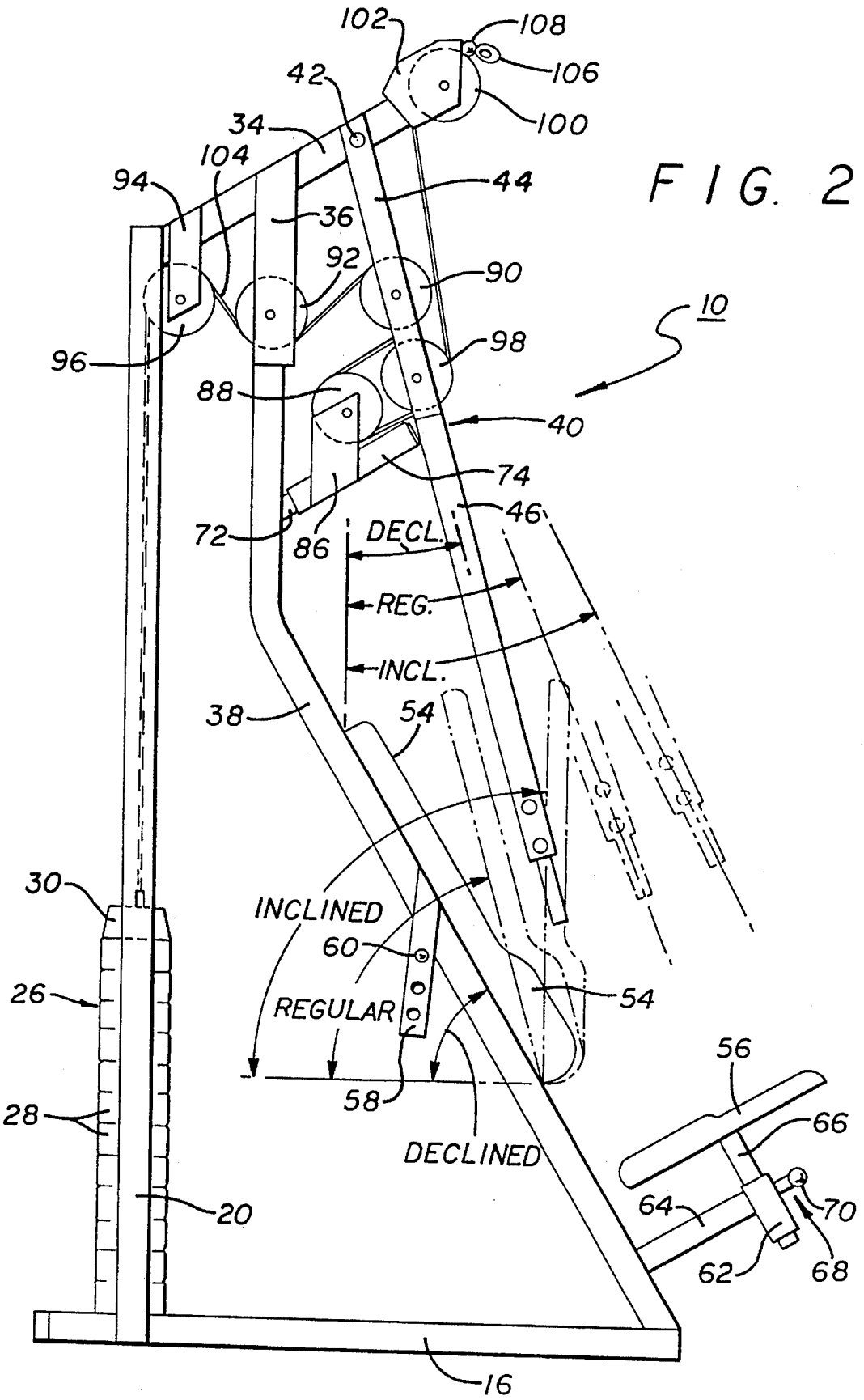
FIG. 2 is a side view of the exercise machine of FIG. 1, showing the press arm and seat adjusted into three different positions.

The seat frame 38 supports a back pad 54 and a seat cushion 56. As shown in FIG. 2, the back pad 54 is coupled to the frame 38 by a first extension bar 58 which has an upper seat pin 60 that extends through the bar 58. The back pad 54 can be moved into positions of different inclinations by removing the pin 60, adjusting the back pad 54 and reinserting the pin 60. The seat frame 38 is bent so that the back pad 54 and seat cushion 56 are at an oblique angle relative to the base member 16. The pin 60 and bar 58 allow the back pad 54 to be adjusted to various exercising positions.

The seat cushion 56 is supported by a seat support 62 which is coupled to the seat frame 38 by a second extension bar 64. The seat cushion 56 is attached to a seat rod 66 that can slide within the seat support 62. The rod 66 is secured to the support 62 by a captured spring loaded pin 68 that extends into one of a number of holes within the rod 66. The pin 68 has a handle 70 that allows the user to release the rod 66 and move the seat cushion 56 into different positions relative to the frame.

As shown in FIG. 3, a frame adjustment arm 72 is attached to seat frame 38. Located on the adjustment arm 72 is an adjustment sleeve 74. The sleeve 74 can slide over the adjustment arm 72 in a telescopic manner. As shown in FIG. 4, the sleeve 74 has a pin housing 76 that contains a captured adjustment pin 78. The pin 76 extends through the sleeve 74 and can be inserted into one of a number of adjustment holes 80 located in the adjustment arm 72. The pin 78 also has a handle 82 that allows the user to pull the pin 78 out of the hole 80 and move the sleeve 74 relative to the arm 72. A spring 84 is coupled to the pin 78, so that the pin 78 is biased into the inserted position.

The sleeve 74 creates a stop for the press arm 40 and defines the rest position of the arm 40. The rest position of the arm 40 can be changed by moving the sleeve 74 relative to the adjustment arm 72. To move the sleeve 74, the user pulls the pin handle 82 to disengage the pin 78 from the adjustment arm 72. The sleeve 74 is moved to the next hole 80 location and the handle 82 is released. The pin 78 enters the hole 80 and secures the sleeve 74 to the arm 72. Alternately, the handle 82 can be released while the sleeve 74 is being moved, wherein the spring 84 will push the pin 78 into the hole 80 when the pin 78 and hole 80 become aligned.

The sleeve 74 has a pair of first pulley brackets 86. The pulley brackets 86 support a first pulley 88 that moves with the sleeve 74. As shown in FIG. 2, a second pulley 90 is mounted on the support bars 44 and rotates with the press arm 40. A third pulley 92 is mounted on the seat frame support brackets 36. Extending from the top member 34 are a pair of second pulley brackets 94 that support a fourth pulley 96. A fifth pulley 98 is mounted on the support bars 44 immediately below the second pulley 90. A sixth pulley 100 is supported by pulley brackets 102 attached at the forward end of top member 34. The pulleys 88, 90, 92, 96, 98 and 100 each rotate on respective axels to allow rotation relative to the supporting members.

Cable 104 is attached at one end thereof to the lift plate 30. Cable 104 is guided around pulleys 96, 92, 90, 88, 98 and 100 in that order and terminates at loop 106. A lat bar or other exercise device may be attached to loop 106 for performing various pull-down exercises. A ball stop 108 prevents cable 104 from being withdrawn through pulley 100 when tensioned by the performance of other exercises. In an alternative embodiment of the invention, pulleys 98 and 100 could be deleted, in which case cable 104 would be shortened and secured to press arm 40 at approximately the position of pulley 98.

Figure 5:
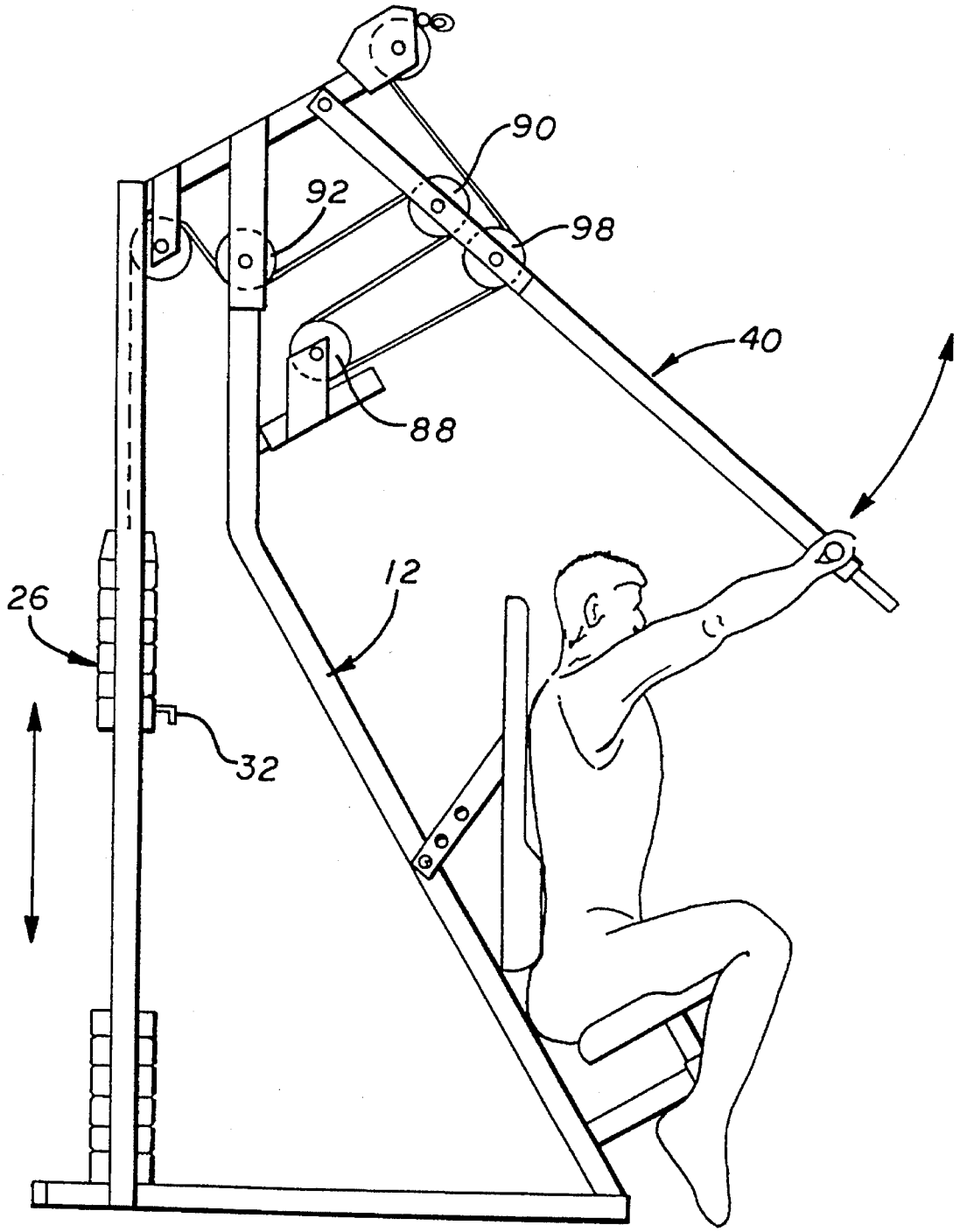
FIG. 5 is a side view showing the press arm being rotated and the weight stack lifted.

As shown in FIG. 5, when a user rotates the press arm 40 forwardly away from the frame 12, the rotation of the arm 40 moves the second pulley 90 away from the first pulley 88. The relative pulley movement pulls the cable 104, which lifts the weight stack 26. When the user reduces or eliminates the force on the arm 40, the weight of the weight stack 26 pulls the same back toward the rest position. The movement of the weights induces a force in the cable 104 which pulls the arm 40 back toward the frame 12. The user can thus perform an exercise routine by pushing the press arm 40 forward and lifting the weights, and then allowing the weights 26 to fall and the arm 40 to swing back toward the frame 12.

As shown in FIG. 3, the sleeve 74 can be moved to change the rest position of the press arm 40. In the preferred embodiment, there are three different holes 80 in the adjustment arm 72, so that the arm 40 can be moved into one of three rest positions, which will be referred to as the decline position, regular position, and incline position. The back pad 54 is also preferably adjusted into one of three different positions. For reference purposes, the three positions will also be referred to as the decline, regular and incline positions.

The press arm 40 and back pad 54 are typically moved in synchronization so that both members are in either the decline, regular or incline positions. The positions of the arm 40 correlate to the positions of the back pad 54, so that the relative distance between the press arm 40 and the user is approximately the same for each position. Therefore, the distance between the user and press arm 40, when the arm 40 and back pad 54 are in the decline position, is the same as the user-to-arm distance when the arm 40 and back pad 54 are in the incline position.

The relationship between the pulleys is such that the cable is always slack free for each rest position of the press arm. The user can therefore adjust the press arm and back pad to a number of exercise positions without creating slack in the system. The rest position of the press arm 40 and the inclination of back pad 54 may be adjusted independently of each other. Adjusting only the press arm allows the same user to begin an exercise routine from a number of different starting positions. Additionally, the back pad can be adjusted independently of the press arm to provide an additional number of operating positions.

The spatial relationship between pulleys 88, 90, 92, 98 and 100 is such that the total length of cable 104 extending between pulleys 88 and 100, both of which are fixed relative to frame 12, is always constant for any position of adjustment sleeve 74. Thus, as sleeve 74 and press arm 40 are moved from the decline position to the regular position and then to the incline position, the increase in the amount of cable extending between pulleys 90 and 92 is offset by a corresponding decrease in the amount of cable extending from pulley 90, around pulleys 88 and 98, to pulley 100. The offsetting cable lengths insure that cable 104 is always slack free for each resting position of press arm 40.

While certain exemplary embodiments have been described in detail and shown in the accompanying drawings, it is to be understood that the embodiments shown and described are merely illustrative of and not restrictive on the broad invention, and that the present invention not be limited to the specific arrangements and constructions shown and described since various other modifications may occur to those ordinarily skilled in the art.

What is claimed is:

1. An exercise machine, comprising:

a frame;

an exercise member pivotally coupled to said frame;

a weight adapted to move relative to said frame;

a cable operatively connected to said exercise member and said weight such that said weight moves relative to said frame when said exercise member is moved relative to said frame;

adjustment means coupled to said frame for engaging said exercise member to define a rest position of said exercise member, said adjustment means being selectively secured to said frame in one of at least two positions, thereby defining a respective one of at least two rest positions for the exercise member, wherein said adjustment means includes a sleeve that slides along an adjustment arm which extends from said frame, said sleeve being adapted to engage said exercise member to define the rest position thereof; and pulley means connected to said adjustment means and said exercise member for guiding said cable from said exercise member to said weight, said pulley means being adapted to keep said cable free of slack for each rest position of said exercise member.

2. The machine as recited in claim 1, wherein said adjustment means includes a spring loaded pin attached to said sleeve, said spring loaded pin being adapted to be inserted into one of a plurality of holes in said adjustment arm to secure said sleeve to said adjustment arm.

3. The machine as recited in claim 1, wherein said pulley means includes a first pulley attached to said adjustment means and a second pulley attached to said exercise member.

4. The machine as recited in claim 1, wherein said exercise member is a press arm.

5. The machine as recited in claim 1, further comprising a seat attached to said frame, said seat being adapted to be adjusted into one of at least two positions.

6. An exercise machine, comprising:

a frame having an adjustment arm;

a press arm that can rotate relative to said frame from a rest position;

a sleeve adapted to engage said press arm to define the rest position of said press arm, said sleeve being constructed to slide along said adjustment arm to move the rest position of said press arm into one of at least two positions;

a weight adapted to move relative to said frame;

a first pulley connected to said sleeve;

a second pulley connected to said press arm;

a cable operatively connected to said press arm, coupled to said first and second pulleys and attached to said weight such that said weight moves when said press arm rotates relative to said frame.

7. The machine as recited in claim 6, further comprising a seat attached to said frame, said seat being adapted to be adjusted into one of at least two positions.

8. The machine as recited in claim 6, further comprising a third pulley attached to said frame and coupled to said cable to further guide said cable from said second pulley to said weight.

9. The machine as recited in claim 7, further comprising a fourth pulley attached to said frame and coupled to said cable to further guide said cable from said third pulley arm to said weight.

10. The machine as recited in claim 9, further comprising a spring loaded pin attached to said sleeve, said spring loaded pin being adapted to be inserted into one of at least two holes in said adjustment arm to secure said sleeve to said adjustment arm.

11. An exercise machine comprising;.

a frame;

a press arm movably coupled to said frame;

means for providing a selectable amount of exercise resistance;

a cable for coupling the selectable amount of exercise resistance to the press arm, said cable following a cable path between the exercise resistance means and the press arm;

an adjustable stop coupled to said frame for defining one of a plurality of rest positions of the press arm, wherein adjustment of said stop repositions the cable path so that the cable remains substantially slack free for each of the plurality of rest positions, wherein the adjustable stop comprises an arm member fixed to the frame and a sleeve member telescopically adjustable along the arm member.

* * * * *

UNITED STATES PATENT AND TRADEMARK OFFICE

CERTIFICATE OF CORRECTION

PATENT NO. : 5,597,257

DATED : January 28, 1997

INVENTOR(S) : Habing

It is certified that error appears in the above-identified patent and that said Letters Patent is hereby corrected as shown below:

In column 6, claim 9 at line 31, please delete " 7 " and insert -- 8 --.

Signed and Sealed this

Thirty-first Day of March, 1998

*Attest:*

*Attesting Officer*

BRUCE LEHMAN

*Commissioner of Patents and Trademarks*